US005271967A

United States Patent [19]

Kramer et al.

[11] Patent Number: 5,271,967

[45] Date of Patent: Dec. 21, 1993

[54] METHOD AND APPARATUS FOR APPLICATION OF THERMAL SPRAY COATINGS TO ENGINE BLOCKS

[75] Inventors: Martin S. Kramer, Romeo; Larry E. Byrnes, Rochester Hills; Gary L. Holmes, Grand Bland, all of Mich.

[73] Assignee: General Motors Corporation, Detroit, Mich.

[21] Appl. No.: 933,128

[22] Filed: Aug. 21, 1992

[51] Int. Cl.[5] ..... B05D 1/08; B05D 7/22

[52] U.S. Cl. ..... 427/455; 427/456; 427/236; 427/239; 427/319; 427/328; 29/888.061

[58] Field of Search ..... 427/455, 456, 449, 236, 427/239, 319, 328; 29/888.061, 888.048

[56] References Cited

U.S. PATENT DOCUMENTS 5,080,056 1/1992 Kramer et al. ..... 123/193 CP

*Primary Examiner*—Shrive Beck
*Assistant Examiner*—David M. Maioran
*Attorney, Agent, or Firm*—George A. Grove

[57] ABSTRACT

A method for the application of a thermal spray coating to the cylinder wall portions of an aluminum engine block casting is disclosed in which the casting is inverted and water is caused to flow through the cooling passages of the engine block in a series flow from one end of a bank of cylinders to the other while the block is supported on a fixture that seals the cooling passage outlets in the head of the block. The fixture further permits the spray of a metallized coating onto the cylinder walls without adherence of the spray to the fixture or to other portions of the block.

8 Claims, 1 Drawing Sheet

METHOD AND APPARATUS FOR APPLICATION OF THERMAL SPRAY COATINGS TO ENGINE BLOCKS

This invention pertains to the application of thermal spray metal alloys to engine block castings. More specifically, this invention pertains to a method and fixture for the application of thermal spray metal alloy coatings to the cylinder walls of aluminum engine block castings.

BACKGROUND OF THE INVENTION

U.S. Pat. No. 5,080,056 issued Jan. 15, 1992 describes a practice of applying thermal spray aluminum bronze wear-resistant coatings on the cylinder bore portion of an aluminum engine block casting. The need for the application of such wear-resistant coatings arises from the fact that aluminum alloys such as aluminum alloy 319, which are particularly suitable for casting complex engine block castings, do not necessarily provide wear resistance against the pistons reciprocating at high speed in the cylinders of the engine.

Our copending application, U.S. Ser. No. 938,528 describes a practice for cleaning and surface roughening metal substrate surfaces preparatory to the deposition of adherent thermal spray metal coatings. That practice is now preferred for use in the deposition of suitable wear-resistant thermal spray metal alloy coatings to cylinder wall surfaces of cast aluminum alloy engine blocks. In such coating of internal surfaces of the complexly configured engine block castings, it is also necessary to provide for the handling of the casting to facilitate the cooling of the block during application of the hot coating and to prevent deposit of the coating where it is not wanted.

It is an object of the present invention to provide a method for the application of a thermal spray coating to the cylinder wall portions of a cast aluminum automotive engine block so as to minimize the need for masking of the cylinder block and to avoid thermal damage to the block from the hot metal droplets that form the coating.

It is a further object of the present invention to provide a method for applying thermal spray, wear-resistant coatings such as aluminum bronze alloys or suitable steel alloys to the cylinder wall portions of an engine block which utilizes the cooling passages of the block to preheat the block preparatory to applying the coating and to cool the block during the coating process.

It is a still further object of the present invention to provide apparatus for the cooling of a cast aluminum engine block and the application of a thermal spray metal coating which does not require masking of the block to prevent overspray into regions of the block not intended to be coated.

In accordance with a preferred embodiment of our invention, these and other objects are accomplished as follows.

BRIEF DESCRIPTION OF THE INVENTION

Automobile engine blocks are now frequently cast of suitable aluminum alloys to reduce the mass of the engine. A commonly used aluminum alloy for this purpose is AA 319 alloy. This alloy nominally contains, by weight, 90.2 percent aluminum, 6.3 percent silicon and 3.5 percent copper. It is a material that is fluid and easily cast into the complex configuration of the engine block. In the practice of our invention, the cylinder walls are cast a few thousandths of an inch oversize on their internal diameter to accommodate a thermal spray coating. The cylinder wall surfaces are then cleaned and surface roughened to receive a thermal spray, metal alloy coating.

In accordance with the practice of our invention, we invert the cast block to facilitate the application of the thermal spray coating without a requirement for masking of any portion of the casting. The top of a typical engine block casting is the head portion. It is a substantially flat surface adapted to receive a separate casting, which is the cylinder head portion of the engine. A cast engine block typically includes one or two banks of a plurality of in-line cylinders defined by cast surfaces. Each cylinder has an open end terminating in the flat head portion of the casting. The other end of each cylinder is an opening at the crankshaft journal region of the casting. In accordance with our invention, we invert the casting with respect to its normal operating position so that the flat head portion is downward in a generally horizontal plane.

We support the inverted casting on a fixture which will be described in more detail below but which is arranged and constructed to close off the openings in the water coolant passages at the head surface of the casting. The coolant passages are formed in the casting around and adjacent each cylinder wall. These water coolant passages in each cylinder bank are interconnected so that, in the operation of the fully-assembled engine, coolant flows through them around each cylinder to cool the operating engine. In accordance with our method, we introduce water to the casting through the supporting fixture. Water is introduced into the cylinder coolant passages at one end of the cast engine block and caused to completely fill the cooling passages and flow around each cylinder in turn, completely traversing the bank of cylinders until it exits, suitably through the water pump opening at the opposite end of the cast block. While the cooling passage openings in the head end of the block are closed by the fixture, the cylinder openings are left uncovered by the fixture.

In accordance with a preferred embodiment of our invention, we thoroughly clean the cylinder wall surfaces. This may be done advantageously while the engine block is in its inverted position as described. Our practice of utilizing a jet blast of high pressure, high velocity water is fully described in our copending application G-9620. We lower and raise a rotating water spray nozzle along the axis of each cylinder. The high pressure water jet thoroughly cleans the surface and roughens it by abrading many small pits into the surface of the cast aluminum alloy. The texture of the pits is characterized by mean peak-to-peak distances of up to about 50 micrometers. The clean pitted surface provides increased surface area and surface irregularities which are filled by the subsequently applied thermal spray coating and provide a superior basis for bonding and anchoring the coating to the casting.

Following such cleaning and surface roughening of each cylinder wall, the surface is ready for the application of a thermal spray coating.

We introduce water at a temperature of about 180° F. to 210° F. at one end of the bank of cylinders from the lower end of the inverted block (the head surface end), filling each cooling passage portion around each cylinder and causing the water to flow sequentially around each cylinder and exit at the opposite end of the block. This process forces air out of the cooling passages and promotes uniform water flow through the water jacket to improve cooling efficiency. The warm water first warms the block to a temperature of 180° F. to 210° F. in preparation for the application of the thermal spray coating.

We prefer the use of the known high velocity oxygen hydrocarbon fuel practice (HVOF) for the application of the thermal spray coating (see, for example, U.S. Pat. No. 5,080,056). In this practice, a spray gun is introduced into the cylinder cavity and moved up and down along its axis. The spray gun comprises a longitudinal tube which conducts oxygen, propylene and air at supersonic speeds to and through a spray nozzle at the end of the tube. The mixture is ignited at the nozzle to generate a flame temperature of the order of 5000° F. A wire of suitable alloy is introduced down the middle of the tube and melted at the nozzle in the hot combustion gases. The high velocity combustion gases disperse the molten alloy as atomized droplets and propel them against the adjacent cylinder wall. The spray gun is rotated as it is translated up and down along the axis of the cylinder.

The nozzle of the spray gun is directed so as to spray at a suitable angle below the horizontal plane. By controlling the feeding of the wire and the vertical translation of the spray gun, the overspray goes out the open end of the engine block casting and does not coat surfaces of the casting other than those of the cylinder wall. When we wish to terminate spraying, we pull out the wire and shut off the gas flow and lift the spray nozzle out of the cylinder. Thus, because of the inverted position of the casting and the uncovered open end of the cylinder at the cylinder head surface, any overspray actually completely exits the engine block casting and does not fall on any surface of the casting that does not require a coating. No labor-consuming masking of the casting is required. Furthermore, we can provide a relieved or chamfered portion at the cylinder openings of our block-supporting fixture so that overspray does not coat the fixture but goes into a dust collection system or the like.

Following this application of the thermal spray coating, the cooling water is drained from the casting, it is lifted from the fixture, and the coated cylinder wall portions suitably machined to achieve a finished dimension.

Other objects and advantages of our invention will be more fully appreciated in view of a detailed description of our invention in which reference will be had to the drawings.

DETAILED DESCRIPTION OF THE INVENTION

The practice of our invention will be described in terms of the thermal spray coating of the cylinder wall portions of an aluminum alloy 319 cast engine block for a four cylinder engine. This particular embodiment is selected for illustration purposes only, and it will be appreciated that the practice of our invention could be applied to other alloys and to other engine block configurations.

Figure 1:
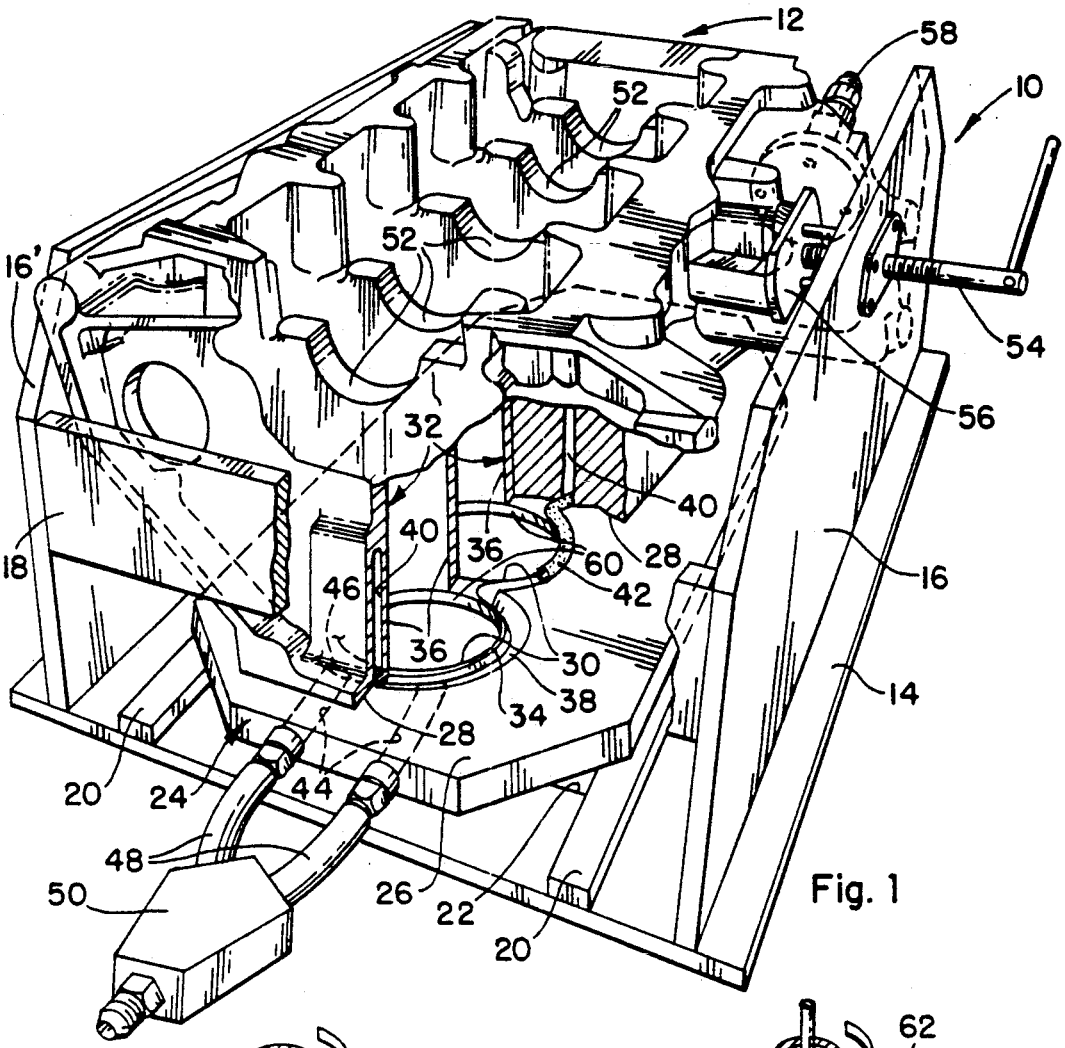
FIG. 1 is a perspective view, partly broken away, of an inverted engine block casting supported on a thermal spray coating fixture as utilized in the practice of our invention.

In FIG. 1 we show a perspective view partly broken away of a fixture 10 supporting the engine block casting 12 for a four cylinder engine. Fixture 10 comprises a bottom plate 14 with two parallel vertical side plates 16 and 16' mounted on it. Vertical side plates 16 and 16' are spaced apart to accommodate the width of the engine casting 12. End plate 18 provides additional support to side plates 16 and 16'. Bottom plate 14 carries two longitudinal rails 20 which are parallel to each other and run substantially the length of the bottom plate 14. Bottom plate 14 has an opening 22 in its central portion which permits water and oversprayed metal droplets to pass through the fixture as will be described below. Rails 20 carry an engine block support plate 24. Engine block support plate 24 is adapted for each engine block design that is to be treated in the fixture 10. The upper surface 26 of plate 24 is substantially flat so as to engage the flat head surface of engine block 12. The flat head surface of the engine block 12 is indicated at 28 in FIG. 1 but is not fully seen because it is pressed against the top plate surface 26. Openings 30 are cut in support plate 24 to precisely coincide with the head surface openings in cylinders 32 of cast block 12. Lips 34 in plate surface 26 are adapted to sealingly engage the head surface 28 of cylinders 32 with cylinder wall surfaces 36. Adjacent the lips 34 in support plate surface 26 is a groove 38 which overlies and traces the coolant passage openings 40 in cylinder wall 36. Located in the groove 38 in the support plate 24 is a high temperature-resistant O-ring 42 that serves to seal the coolant openings. However, in the support plate 24 at one end are conduits 44 for admitting water through openings 46 in O-ring 42 to the cooling passage 40. Water is supplied to conduits 44 through hoses 48 and flow divider 50.

In an alternative embodiment, two grooves (like groove 38) may be formed in plate 24 with corresponding O-rings to provide sealing means at each side of coolant passage opening 40.

Thus, the support plate surface 26 engages the flat head surface 28 of the cylinder block. It provides for sealing means 42 to close off the coolant passages 40 in the cylinder block 12 but provides openings 30 through the support plate 24 that are coincidental with the cylinder openings in the head surface 28 of the block 12.

As seen in FIG. 1, the inverted engine block 12 has a series of bearing journals 52 adapted to receive bearing members (not depicted) that in turn will engage journals on the crankshaft (not depicted) that will ultimately be assembled against this portion of the engine block 12. Of course, in the operation of the engine, the crankshaft will carry four connecting rods, which in turn will be connected with pistons that will reciprocate in the respective cylinders of the engine.

In connection with the subject thermal spray coating operation, the engine block is inverted and held in the fixture 10. It is pressed against one vertical wall 16' of the fixture 10 by a screw clamp 54 (in wall 16) with pressure plate 56.

At the distant end of the fixture, as depicted in FIG. 1, water removal means 58 is provided to sealingly connect to the water pump opening in the block so that water can be removed from cooling passages 40 during the thermal spray operation, which will be described in more detail below. Thus, as depicted in FIG. 1, the fixture 10 permits water to be introduced through conduits 44 to ports in the groove 38 of the support plate 24 at two locations into the coolant passages 40 of the closest cylinder 32 depicted in the illustration. The water flows along the passages 40 around each cylinder 32, filling these passages and driving air from the block through the water pump opening at the upper far end of the block and fixture as depicted in FIG. 1. Once the cooling water has completely filled normal cooling passages of the block 12, it exits at the now upper end of the water passages in the inverted block.

The undersurface of the support plate 24 adjacent each cylinder 32 opening in the cast engine block is machined away at an angle of about 40 degrees below the horizontal surface 26. The resulting chamfered surface 60 is thus out of the flow path of the sprayed droplets of molten metal. When HVOF spray head 62 reaches the lowest point of its travel, any overspray passes out of the cylinder 32 and through the opening 30 in this support plate 24 without adhering to it. Thus, in the conduct of our process, we are able to spray the cylinder wall surface 36 and allow overspray at the bottom end of the cylinder wall surface (as depicted in FIG. 1) to exit the open end of the cylinder and pass through the opening in plate 24 without depositing on any part of the support plate 24 or fixture 10 or indeed any part of the engine block that is not intended to be coated.

Figure 2:
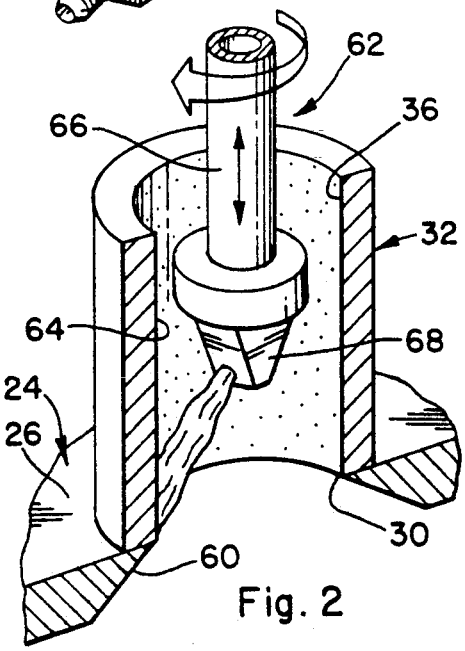
FIG. 2 is a view partly broken away of an isolated cylinder portion of the engine block casting and support fixture illustrating the preheating of the cylinder wall surfaces by the thermal spray head with no wire inserted.
Figure 3:
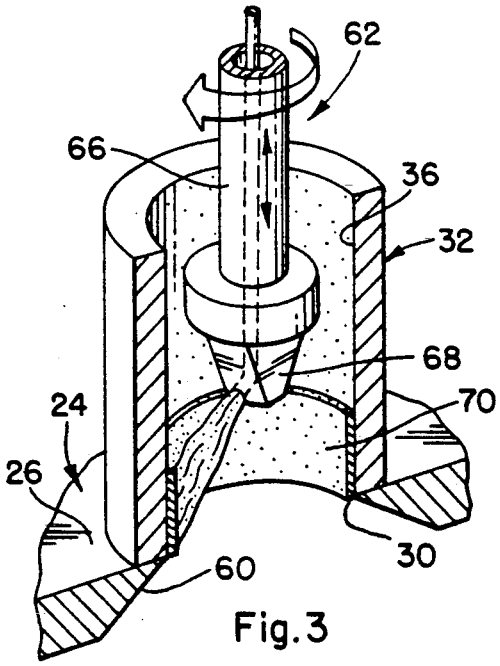
FIG. 3 illustrates the spraying process on an isolated cylinder wall.

FIGS. 2 and 3 depict an HVOF spray head 62 in an isolated cylinder 32 (with cylinder wall surface 36) removed schematically from the engine block for purposes of clear illustration. However, it will be appreciated that these cylinder structures are an integral part of engine block casting 12. FIGS. 2 and 3 also illustrate the chamfered surface 60 in support block 24.

The Thermal Spray Process

A cast cylinder block with cylinder wall passages machined to a desired oversized diameter for the application of a thermal spray coating is prepared. The block 12 is inverted and clamped into fixture 10 like that depicted in FIG. 1. Connection is made to a water source so as to supply water through the support plate 24. Water at a temperature in the range of 180° F. to 210° F. is delivered to the cast and machined block 12. It is introduced into the cylinder head opening of the coolant passage 40 of the cylinder 32 at one end of the block. As described above, the water rises uniformly around each cylinder, completely filling the passages by expelling air from the high end of the passage at the water pump. Water then flows in laminar flow fashion around each cylinder wall in succession, preferably at a rate of about five to seven gallons per minute. The warm water preheats the cylinder to a temperature of the order of 180° F. to 210° F. This temperature is maintained in the block throughout the coating process by use of a closed loop temperature controller system.

Preferably, the cylinder wall surfaces are pretreated with a high velocity, high pressure water jet which thoroughly cleans the surface of machining debris and lubricants and other foreign matter which would impede adherence of a thermal spray coating. The pressure and velocity of the water jet blast is controlled as described in our copending application, Ser. No. 07/932,528 filed on Aug. 20, 1992, so as to not only clean the surface but provide a textured surface that is characterized by a large number of small pits, the pits being further characterized by a mean peak-to-peak distance of the order of 50 micrometers or less. This roughened texture 64 is indicated by the dotted surface on cylinder wall surface 36 as shown in FIGS. 2 and 3. As soon as this water cleaning and roughening step has been carried out or other suitable separate cleaning and surface roughening steps followed, the block is ready for the application of the thermal spray coating.

We employ a thermal spray gun 62 of a type that is commercially available. Gun 62 is depicted schematically for simplicity of illustration. It comprises a long shaft 66 with a spray nozzle 68. The apparatus is automatically controlled by suitable commercially available means (not shown) so that it can be rotated at the axis of the cylinder and moved up and down along the cylinder axis to apply a uniform coating of the thermal spray metal. The shaft 66 is suitably provided with separate passages for oxygen, propylene, air and wire. Propylene and oxygen join and mix in the shaft. Air and wire join the oxygen-propylene mixture in the combustion zone (not shown) in the nozzle 68 where combustion occurs and the wire melts in the high temperature flame (about 5000° F.). The gases flowing at supersonic speed propel the molten droplets against the surface to be coated.

In the practice of our process, we first heat the cleaned and pitted cylinder wall 64 with the hot high velocity gases while the gun is rotating and traversing from an upper position in the block as it is depicted in FIG. 1 to the lower end of the cylinder, which is actually the cylinder head surface of the casting. The nozzle 68 is arranged and constructed so as to direct the flame and the subsequent spray at an angle of 50 to 60 degrees downwardly from the horizontal plane at the nozzle outlet. Once the gun 64 has completed the length of the cylinder in the downward direction, its downward movement is stopped but its rotation is continued.

At this time, a wire formed of the thermal spray alloy to be applied is inserted in the shaft as depicted in FIGS. 2 and 3. A suitable alloy is an aluminum bronze composition, for example, or a low carbon, low alloy steel composition. When the wire reaches the nozzle and is exposed to the high temperature flame, it melts, and molten droplets (at about 1900° F. in the case of aluminum bronze alloys) are formed which are propelled with the high velocity gases out through the nozzle 68 toward the cylinder wall 64 to form a dense, adherent coating 70. When the nozzle is at the bottom position, any overspray misses the cylinder block 12 and the fixture 10 flowing through the openings (including opening 30 in support 24) into a dust collector or other suitable repository below the fixture. The gun 62 is then translated up and down in the cylinder 32 with the spraying of the metal ongoing. Because of the angle of the spray, the upward position of the gun can define the highest position that the coating 70 is applied on the cylinder wall, and any overspray in the lower position simply exits the open end of the cylinder head. In this way, the thermal spray coating is applied only to the intended portions of the cylinder wall, and there is no overspray that needs to be masked from the cylinder block 12 or from the fixture 10.

By applying the thermal spray coating in the way described, we also prevent overheating by utilizing the engine block cooling passages 40. Coincidentally, the thermal spray coating is applied principally to those areas of the cylinder wall surfaces 36 that are backed up with cooling passages 40. Thus, by coating in the practice described, we prevent overheating of the block and eliminate the need for masking against coating overspray.

Once the desired coating thickness has been built up by repeated up and down traverses of the gun within the cylinder, the wire feed is shut off with the gun at the bottom of the stroke outside the cylinder. Thus, coating is stopped with the flame still on. The gun is traversed back up the cylinder. The deposited metal forms a fully dense, adherent coating against the pitted aluminum surface. The gun can then be removed from the bore and inserted into another cylinder passage for thermal spray coating. Obviously, more than one gun can be used at the same time, and more than one cylinder can be coated at the same time. The water is drained from the block at the completion of the coating steps.

Thus, by applying the thermal spray coating to the cylinder in the inverted position, we are able to control the temperature of the coated surfaces while controlling the pattern of any overspray. We eliminate thermal damage to the block as it is being coated and eliminate the need for masking of the block.

While our invention has been described in terms of a preferred embodiment thereof, it will be appreciated that other forms could readily be adapted by one skilled in the art. Accordingly, the scope of our invention is to be considered limited only by the following claims.

The embodiments of the invention in which an exclusive property or privilege is claimed are defined as follows:

1. A method of applying a thermal spray metallic coating to cylinder wall portions of a cast aluminum block member of a water-cooled engine, said block comprising a bank of in-line parallel cylinders defined by cast surfaces and each terminating at one end in an opening in a flat head surface of the casting, and a passage for coolant adjacent a portion of each cylinder wall, the passages extending to openings at the head surface and being interconnected with the passage of the adjacent cylinder, said method comprising inverting the block with its flat head surface downward and closing the coolant passage openings at the head end of the block without closing the cylinder openings, flowing water through the coolant passages from an inlet at the head opening adjacent the cylinder at one end of the bank to completely fill the coolant passages and to pass around each cylinder in the bank in series flow and exit at the upper end of the passage at the opposite end of the bank to maintain the cylinder wall surfaces at a suitable temperature for the application of spray droplets of molten alloy, and spraying molten droplets of an alloy onto the surface of the cylinders and solidifying them thereon in an adherent, dense coating of said alloy over selected portions of each cylinder surface without thermal damage or distortion to the casting, the spray pattern being such that overspray exits the cylinder at the head end without coating block surfaces not intended to be coated.

2. A method in accordance with the method of claim 1 wherein the water flowing through the coolant passages is employed to initially preheat the cylinder wall surfaces toward a suitable metal spray temperature and thereafter cool the casting during the metal spray application so as to prevent thermal damage to the casting.

3. A process as recited in claim 1 where, prior to the application of the thermal spray coating, the cylinder wall surfaces of the casting have been cleaned and provided with a roughened surface texture by the impingement over the entire surface of a water jet stream.

4. A method as recited in claim 1 where the inverted engine block casting is supported on a fixture that seals the cooling passage openings at the head surface of the casting so as to permit the admission of the water flow at one end only of the casting and require the exit at an elevated place at the opposite end of the casting.

5. A method as recited in claim 1 in which the engine block casting is supported on a flat fixture plate with circular openings adjacent the cylinder openings of the cast block and the bottom-most surface of the supporting plate is chamfered outwardly so that thermal spray being applied to the cylinder bore does not adhere to the fixture.

6. A method as recited in claim 5 where the thermal spray is accomplished by a rotating spray nozzle that is rapidly rotated and translated along the axis of the cylinder bore so as to apply a uniform thermal spray coating to the cylinder wall by a series of rotating passes over the wall.

7. A method as recited in claim 1 where the molten alloy to be applied to the cylinder bore surfaces is melted in a high velocity stream of an oxygen hydrocarbon fuel mixture and therein atomized and propelled to the surface of the bore.

8. A method as recited in claim 7 where the cylinder wall is additionally preheated by application of the hot exhaust gas of the oxygen hydrocarbon fuel without insertion of the metal alloy into the gas stream and thereafter inserting the metal alloy into the stream to apply the molten droplets of the alloy to the gas preheated surface.

* * * * *